US007512368B2

(12) United States Patent
Zess et al.

(10) Patent No.: US 7,512,368 B2
(45) Date of Patent: Mar. 31, 2009

(54) CLEANING SYSTEMS FOR FUSER MEMBERS AND METHOD OF CLEANING FUSER MEMBERS

(75) Inventors: Matin F. Zess, Churchville, NY (US); Mark S. Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 265 days.

(21) Appl. No.: 11/553,624

(22) Filed: Oct. 27, 2006

(65) Prior Publication Data

US 2008/0101828 A1 May 1, 2008

(51) Int. Cl.
*G03G 15/20* (2006.01)

(52) U.S. Cl. ..... 399/327

(58) Field of Classification Search ..... 399/325–327
See application file for complete search history.

(56) References Cited

U.S. PATENT DOCUMENTS

| | | | |
|---|---|---|---|
| 3,649,992 | A | 3/1972 | Thettu |
| 3,986,227 | A | 10/1976 | Fathergill et al. |
| 4,607,947 | A | 8/1986 | Ensing et al. |
| 5,045,890 | A | 9/1991 | DeBolt et al. |
| 5,142,340 | A | 8/1992 | Farrell et al. |
| 5,327,203 | A | 7/1994 | Rasch et al. |
| 5,353,106 | A | 10/1994 | Agarwal et al. |
| 6,487,389 | B2 | 11/2002 | Jia et al. |
| 6,876,832 | B2 | 4/2005 | Pirwitz et al. |

FOREIGN PATENT DOCUMENTS

| | | |
|---|---|---|
| JP | 02266383 | * 10/1990 |

OTHER PUBLICATIONS

U.S. Patent Appl. No. 11/240,606, filed Sep. 30, 2005 in the name of Pino et al.
U.S. Patent Appl. No. 11/453,949, filed Jun. 15, 2006 in the name of Klymachyov et al.

* cited by examiner

*Primary Examiner*—Hoang Ngo
(74) *Attorney, Agent, or Firm*—Oliff & Berridge, PLC

(57) ABSTRACT

Cleaning systems for cleaning fuser devices in electrostatographic printing apparatuses and methods of cleaning fuser devices using such cleaning systems are provided. The disclosed cleaning systems include flexible substrates having a surface coated with a high surface-energy film and optionally having an abrasive surface opposite the coated surface. The high surface-energy film contacts a surface of a fuser member and removes contaminants. Optionally, the fuser surface may be pre-cleaned by the abrasive surface prior to contacting the high surface-energy film.

15 Claims, 2 Drawing Sheets

CLEANING SYSTEMS FOR FUSER MEMBERS AND METHOD OF CLEANING FUSER MEMBERS

TECHNICAL FIELD

This disclosure is generally directed to cleaning systems for cleaning fuser devices in electrophotographic printing apparatuses and to methods of cleaning fuser devices using such cleaning systems. In particular, this disclosure provides cleaning systems including flexible substrates coated with high surface-energy films, and processes for cleaning fuser devices in electrophotographic imaging members by contacting the fuser device with the high surface-energy film coatings of such flexible substrates.

RELATED APPLICATIONS

Reference is made to the following patent properties: (1) Co-pending application Ser. No. 11/240,606 to Pino et al., filed Sep. 30, 2005, and (2) Co-pending application Ser. No. 11/453,949 to Klymachyov et al., filed Jun. 15, 2006.

Appropriate components and process aspects of each of the foregoing may be selected for the present disclosure in embodiments thereof. The entire disclosures of the above-mentioned applications are totally incorporated herein by reference.

REFERENCES

U.S. Pat. No. 3,986,227 to Fathergill et al. describes a scraping cleaning apparatus for cleaning contaminating material from the surface of a roll, wherein the coefficient of friction of the roll's surface is less than the coefficient of friction of the contaminating material, the apparatus comprising: a scraping blade having a sharp leading edge positioned to engage the advancing surface of said roll with a given force and at a critical acute angle from the tangent to the roll at the point of engagement, said critical angle being such that the friction-derived force vector lies at a greater angle than said critical angle when said leading edge engages a clean roll surface, and such that the higher friction-derived force vector lies at a lesser angle than said critical angle when said leading edge engages a contaminated roll surface.

Commonly assigned U.S. Pat. No. 3,649,992 describes an apparatus for cleaning heat sensitive toner particles from the surface of a toner fuser roll including a toner removing member comprising a metal cylinder having a high thermal conductivity capable of rapidly transmitting heat energy from said toner to said member and being constructed of a material such that the surface energy between the member and the toner is greater than the surface energy between the fuser roll and the toner, and means to position said toner removing member in contact with the fuser roll whereby toner on the fuser roll is offset to said member.

U.S. Pat. No. 4,607,947 describes a method of removing residues of heat-softened toner and paper dust from the surface of a circulating image fixing member, such as a roller or a belt, that is moved repeatedly through an image fixing zone in which said surface and the surface of a second such circulating fixing member press one against the other to fix a heat-softened toner image being carried into said zone onto a sheet material being passed therethrough between the two surfaces, which method comprises: moving with a said fixing member surface through a contact cleaning zone of its path beyond said fixing zone a circulating cleaning surface having thereon a toner layer to which said toner and paper dust will adhere preferentially rather than to said fixing member surface, said cleaning surface having a multiplicity of spaced-apart perforations therein for discharging residues from it; in said cleaning zone collecting residues from the said fixing member surface onto and pressing them into said toner layer on areas of said cleaning surface outside said perforations; and by repeated movement of said cleaning surface with said fixing member surface through said cleaning zone continually pressing said toner layer thin and displacing excess material from it into said perforations.

Commonly assigned U.S. Pat. No. 5,045,890 to DeBolt et al. describes a fuser apparatus for heat fusing toner images to a print substrate comprising a fuser roll and a pressure roll forming a fusing nip therebetween, means to deliver liquid release agent to said fuser roll comprising a movable web having a first side and a second side supported between a web supply roll and a web take-up roll, a housing supporting said supply roll and take-up roll such that one of said supply and take-up rolls is on one side of the fuser roll and the other is on the other side of the fuser roll and the first side of the movable web is in contact with the fuser roll along a path parallel to its longitudinal axis, said movable web being impregnated with a liquid release agent, said movable web, supply roll and take-up roll being reversibly mounted in said housing to deliver liquid release agent to said fuser roll initially from said first side of said movable web, means to enable reversing the location of said supply roll and take-up roll in said support housing so that the second side of said impregnated web is in contact with said fuser roll to deliver release agent thereto, said movable web being urged into delivery engagement with said fuser roll by an open celled foam pinch roll impregnated with liquid release agent.

Commonly assigned U.S. Pat. No. 5,142,340 to Farrell et al. describes an improved method of cleaning imaging material from a fuser of a copy reproducing apparatus in a fuser cleaning purge cycle after an inadvertent interruption of the operation of said reproducing apparatus in which said fuser was potentially contaminated with imaging material from a copy sheet being fused, wherein said reproducing apparatus has an alternative duplex copying path, comprising: automatically sequentially feeding a preset limited number of preexisting conventional clean copy sheets in said copy reproducing apparatus through said fuser to function as fuser cleaning sheets to remove said potentially contaminating imaging material from said fuser, then feeding said same fuser cleaning sheets through said alternative duplex copying path of said reproducing apparatus back to and through said fuser a second time, with sheet inversion, so that these fuser cleaning sheets are inverted before said feeding through said fuser said second time, and then purging said same fuser cleaning sheets, to complete said fuser cleaning purge cycle, wherein said fuser cleaning purge cycle is automatically initiated in response to sensing that a copy sheet was stopped in said fuser during said interruption of the operation of said reproducing apparatus.

Commonly assigned U.S. Pat. No. 5,327,203 to Rasch et al. describes an apparatus for applying offset preventing liquid to a fuser roll, comprising: a non-woven oil impregnated web material including sub-denier fibers ranging from about 5% and 50% of said web material by weight, said web material comprises polyaramid fibers and a polyester fiber binder, said polyester fiber binder comprises approximately 70% of said web material by weight with the fibers of said polyester binder being approximately 1.5 denier; and means for urging said web material into contact with the fuser roll to apply release material to the fuser roll.

Commonly assigned U.S. Pat. No. 5,353,106 to Agarwal et al. describes an apparatus for cleaning a cylindrical member rotatable about a longitudinal axis, the apparatus comprising: an absorbent sheet having longitudinal sides joined together at a seam, a generally folded edge along a central longitudinal axis of the absorbent sheet, and inner and outer surfaces; a nonabsorbent barrier layer attached to the inner surface of the absorbent sheet; and means for supporting the outer surface of the absorbent sheet against the rotatable cylindrical member.

Commonly assigned U.S. Pat. No. 6,487,389 B2 to Jia et al. describes a method of refreshing a sticky cleaner member used for cleaning a transfuse member or a fuser member in an electrophotographic printer comprising the steps of: (i) precoating the cleaner member with spent waste toner material prior to a printing operation; and (ii) removing contaminants from the sticky surface of the cleaner member.

Commonly assigned U.S. Pat. No. 6,876,832 B2 to Pirwitz et al. describes an improved fuser apparatus, comprising: a fuser roll and a pressure roll being rotatably mounted parallel to and in contact with each other to form a first nip through which a recording medium with a toner image thereon is passed to permanently fix the image thereto; a cleaning web system for cleaning the fuser roll, the cleaning web system including a web provided on a supply roll, a tension roll having a shaft with opposing ends, and a take up roll, the supply roll, tension roll, and take up roll all being mounted for rotation, said tension roll forming a second nip with the fuser roll, the web passing through the second nip to clean the fuser roll and the web portion used to clean the fuser roll being stored on the take up roll; a torsion spring mounted on at least one end of the tension roll shaft, the torsion spring gripping the tension roll shaft with sufficient frictional force to provide a range of torsional drag forces on the tension roll shaft to prevent rotation thereof during withdrawal of a recording medium from the first nip during a jam clearance in the fuser apparatus, thus preventing inadvertent spooling of web from the supply roll; and wherein the range of torsional drag forces by the torsion spring has a minimum drag force to prevent rotation of the tension roll during a jam clearance and a maximum drag force that is periodically overcome by the rotational force of the take up roll during normal operation of the fuser, so that the cleaning web is stepped from the supply roll onto the take up roll.

The disclosures of each of the foregoing patents and publications, and the disclosures of any patents and publications cited below, are hereby totally incorporated by reference. The appropriate components and process aspects of the each of the cited patents and publications may also be selected for the present compositions and processes in embodiments thereof.

BACKGROUND

Electrophotographic image recording is a well-known and commonly used method of coping or printing documents. Electrophotographic image recording typically is performed by exposing a substantially uniformly charged photoreceptor to a light image of a document. In response to the light image, the photoreceptor discharges to create an electrostatic latent image of the document on the surface of the photoreceptor. Toner particles are then deposited onto the latent image to form a toner image, which is transferred from the photoreceptor, either directly or after one or more intermediate transfer steps, onto a recording substrate, such as a sheet of paper. The transferred toner image is then fixed or fused to the recording substrate using heat and/or pressure. The photoreceptor surface is then cleaned of residual developing material and recharged in preparation for the creation of another image.

This process can be used to produce either black and white images or color images. Color images may be produced by repeating the above process once for each color used to make the color image. For example, the charged photoconductive surface may be exposed to a light image that represents a first color, such as cyan. The resultant electrostatic latent image can then be developed with cyan toner particles to produce a cyan image that is subsequently transferred to an intermediate transfer member or a recording substrate. The process can then be repeated for a second color, such as magenta, then a third color, such as yellow, and finally a fourth color, such as black. Each color toner image may be transferred to the intermediate transfer member or recording substrate in superimposed registration, to produce the desired composite toner powder image. In systems using an intermediate transfer member, successive toner images are transferred in superimposed registration from the photoreceptor onto the intermediate transfer member. Only after the composite toner image is formed on the intermediate transfer member is that image transferred and fused onto the recording substrate. In the alternative, the toner images may be successively transferred onto the recording substrate, and then fused.

Toner particles are usually provided to the photoreceptor as part of a developer. The most common developers are dry powder toners, which typically comprise toner particles and carrier granules. Toner particles triboelectrically adhere to the carrier granules until the toner particles are attracted onto the latent image. An alternative to dry, powder developers is liquid developers. In liquid developers, or liquid inks, toner particles are dispersed in a liquid carrier. When liquid developers are used, both the toner particles and the liquid carrier brought into contact with the electrostatic latent image. The liquid carrier is then removed, for example by blotting or evaporation, leaving the toner particles on the photoreceptor surface.

Fusing can occur after transfer of the toner image to the recording substrate, or transfer and fusing can simultaneously occur in a transfuse process. In either arrangement, the recording substrate is fed into a fusing nip where a combination of fusing members, such as by transfuse or fusing belts or rollers, apply heat and pressure to the toner image and the recording substrate to fix or fuse the toner image to the recording substrate. During the fusing process, toner particles from the toner image and debris from the substrate can adhere to the fusing member. Adhered toner particles and other contaminants can transfer from the fusing member to subsequent documents, resulting in print defects. In addition, toner particle build-up can decrease the operational life of the fusing member. Thus, it is preferred that fusing members be cleaned to remove particulate debris, such as adhered toner particles, dirt and fiber, that can affect final print quality.

Most current fusing systems include a system for automatically cleaning the fuser roll and/or supplying the fuser roll with a lubricant or release agent. For example, the surface of the fuser roll may be cleaned and/or lubricated by means of a web that is pressed against the surface of the fuser roll at a location generally away from the nip formed by the pressure and fuser rolls. The webs of known systems provide either a textured surface or a tacky or sticky surface for removing adhered toner particles from the fuser roll. The web may also provide amounts of lubricant or release agent to the fuser roll. As is well known, the function of the release agent is to prevent sheets of paper that pass through the fuser nip from sticking to the surface of the fuser roll, thus preventing the stuck paper sheets from causing a paper jam. In addition, the release agent minimizes the amount of toner that sticks to the fuser roll rather than remaining on the paper.

Generally, the web is drawn from a replaceable supply roll and is moved at a reasonably slow rate relative to the movement of the fuser roll, causing the surface of fuser roll to rub against a small area of the web. The relatively slow motion of the web provides friction to the fuser roll surface and provides a supply of clean web at a reasonable rate. A typical ratio of surface speeds, for example, in a 60 page-per-minute printer, is approximately 300 mm per second for the outer surface of the fuser roll; in contrast, the speed of the web is 2 to 3 mm per minute. Typically, the web is withdrawn from a supply roll and pulled by and wound on a take up roll.

However, there remains a need for improved systems, apparatuses and methods for cleaning residual toner particles and other debris from fuser rolls of electrophotographic imaging systems.

SUMMARY

The present disclosure addresses these and other needs, by providing a fuser apparatus for an electrophotographic reproducing machine and, more particularly, an improved fuser apparatus for such machine having a fuser member and pressure roll that forms a nip through which a recording medium with a toner image is passed to fuse the image thereto, and a cleaning system for cleaning the fuser member by use of a flexible high surface-energy film.

Exemplary fuser apparatuses include fuser member and a pressure roll that are rotatably mounted parallel to and in contact with each other to form a fusing nip through which a recording medium with a toner image thereon is passed to permanently fix the image thereto; a cleaning system for cleaning the fuser member, the cleaning system comprising: a flexible material having a high surface energy surface; a supply roll for providing the flexible material; and a take-up roll for taking-up the flexible material; wherein: the supply roll and take-up roll are each rotatably mounted parallel to the fuser member; the flexible material contacts the fuser member to form a cleaning nip; the flexible material is passed from the supply roll, through the cleaning nip, and is gathered on the take-up roll; and the flexible material is oriented such that the high surface energy surface contacts the fuser member at the cleaning nip.

Additional exemplary fuser apparatuses include a fuser member and a pressure roll that are rotatably mounted parallel to and in contact with each other to form a fusing nip through which a recording medium with a toner image thereon is passed to permanently fix the image thereto; a cleaning system for cleaning the fuser member, the cleaning system comprising: a flexible material having a high surface energy; a supply roll for providing the flexible material; a tension roll; and a take-up roll; wherein: the supply roll, tension roll and take-up roll are each rotatably mounted parallel to the fuser member; the tension roll is mounted in contact with the fuser member to form a cleaning nip; the flexible material is passed from the supply roll to the tension roll, through the cleaning nip, and is gathered on the take-up roll; and the flexible material is oriented such that the coated surface contacts the fuser member at the cleaning nip.

Exemplary cleaning methods include contacting a fuser member with a flexible material having a high surface energy. In exemplary methods, the cleaning method is conducted using a cleaning system as described above.

These and other features and advantages of various embodiments of materials, devices, systems and/or methods are described in or are apparent from, the following detailed description.

EMBODIMENTS

This disclosure is not limited to particular embodiments described herein, and some components and processes may be varied by one of skill, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise. In addition, reference may be made to a number of terms that shall be defined as follows:

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

Figure 1:
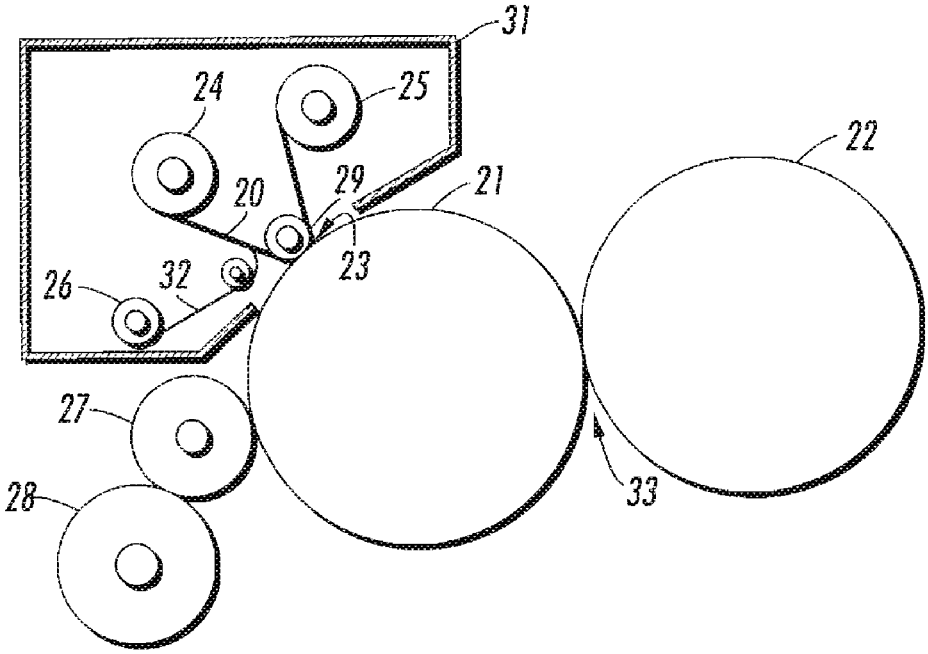
FIG. 1 is a schematic view showing an embodiment of a fuser apparatus of the disclosure.

The fuser apparatuses of this disclosure are described herein with reference to FIG. 1. The fuser apparatuses of embodiments comprise a fuser member 21, a pressure roll 22, a donor roll 27, a meter roll 28 and a cleaning system 31. The cleaning system 31 includes a flexible material 20 having a high surface energy.

The fuser apparatus includes a fuser member 21, which may be heated. The fuser member of embodiments may be in the form of a fuser roll or fuser belt. The fuser member of embodiments may comprise a core that is coated with a thin elastomer layer. The core of the fuser member may be made of any suitable material, including metals such as iron, aluminum, nickel, stainless steel, etc., and synthetic resins. The core may be hollow and include a heating element positioned inside the hollow core to supply the heat for the fusing operation. Heating elements suitable for this purpose are known in the art and may comprise, for example, a quartz heater made of a quartz envelope having a tungsten resistance-heating element disposed internally thereof. In embodiments, the fuser member can be heated by internal means, external means or a combination of both. Heating means are well known in the art for providing sufficient heat to fuse the toner to the recording substrate. The thin elastomer layer may be made of any suitable materials, for example, VITON elastomers and silicone elastomers.

Embodiments of the fuser apparatus described herein also may include a pressure roll 22. The pressure roll 22 may comprise, in embodiments, a metal core with a layer of a heat-resistant material. The metal core of the pressure roll may be made of any suitable metal, and the heat-resistant material layer may be made of any of suitable material. The fuser member 21 and the pressure roll 22 are each rotatably mounted and are in pressure contact with each other to form a fusing nip 33. In operation, a recording substrate may be passed between the fuser member 21 and the pressure roll 22 at the fusing nip 33, and a toner image thereon may be fused onto the recording substrate. In certain embodiments, the fuser member and/or the pressure roll may have profiled engaging surfaces to form a substantially uniform nip across their lengths and provide a substantially constant nip force and a substantially uniform velocity profile to sheets passing through the nip.

The cleaning system 31 of embodiments comprises a high surface-energy material or film that may be coated onto one surface of a flexible substrate 20. The cleaning system is able to remove adhered toner particles and other debris from the surface of the fuser roll due to the high surface energy film that attracts excess toner debris from the fuser roll surface. The high surface-energy film of embodiments comprises a highly pure, oxide-free coating of a high surface energy material. In embodiments, the high surface-energy film may have a relative purity level of about 95%, although the relative purity level may vary, for example, when impurities in the high surface-energy film assist in removing toner particles and debris from the fuser surface. The high surface-energy material of the film may include one or more of aluminum, chromium, nickel, tantalum, and mixtures and alloys thereof.

In embodiments, the high surface-energy film may be sufficiently strong that the high surface-energy film is included without a supporting substrate. That is, the flexible substrate 201 of embodiments may be the high surface-energy film. However, in some embodiments, the high surface-energy film is coated onto the flexible substrate 20 by any known or later developed method. For example, the high surface-energy film may be deposited by sputtering, evaporation, or any known or later developed method of obtaining high-purity films. Any suitable substrate may be used as the flexible substrate 20 herein. However, in particular embodiments, the flexible substrate 20 may comprise materials including natural fibers, synthetic fibers and synthetic films. The flexible substrate 20 may be, in embodiments, a heat-resistant fabric or a heat-resistant plastic film.

The flexible substrate 20 with its coating of high surface-energy film is provided, in embodiments, as a coil on a supply roll 24. Supply roll 24, optional tension roll 29 and take-up roll 25 are each rotatably mounted. In embodiments in which a tension roll 29 is included (such as those shown in FIGS. 1 and 2), tension roll 29 contacts the fuser member 21 to form a cleaning nip 23. The coated, flexible substrate is drawn from supply roll 24, through cleaning nip 23, and onto take-up roll 25. The surface of the flexible substrate 20 that is coated with the high surface-energy film contacts the fuser member 21 at a cleaning nip 23. The high surface-energy film captures toner particles, debris and contaminants from the fuser roll surface upon contact with the fuser member 21, While the tension roll 29 must be positioned in contact with the fuser member 21, there are no particular restrictions on the positions of the supply roll 24 and take-up roll 25.

Figure 3:
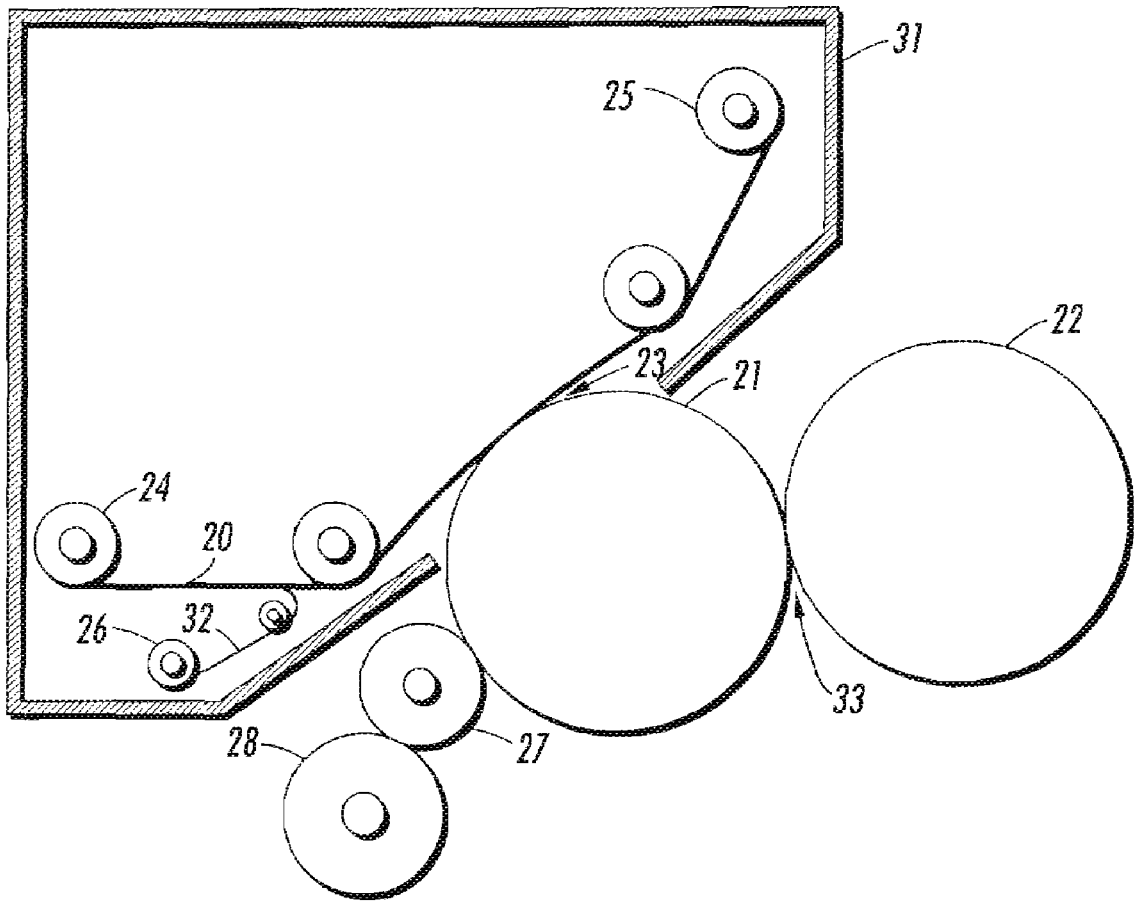
FIG. 3 is a schematic view showing an alternative embodiment of a fuser apparatus of the disclosure.

In embodiments in which a tension roll 29 is not included, the supply roll 24 and take-up roll 25 are positioned such that cleaning nip 23 is formed between the surface of the flexible substrate 20 that is coated with the high surface-energy film and the fuser member 21 at a point of contact between the fuser member 21 and the high surface-energy film, as shown in FIG. 3. The high surface-energy film captures toner particles, debris and contaminants from the fuser roll surface upon contact with the fuser member 21.

Figure 2:
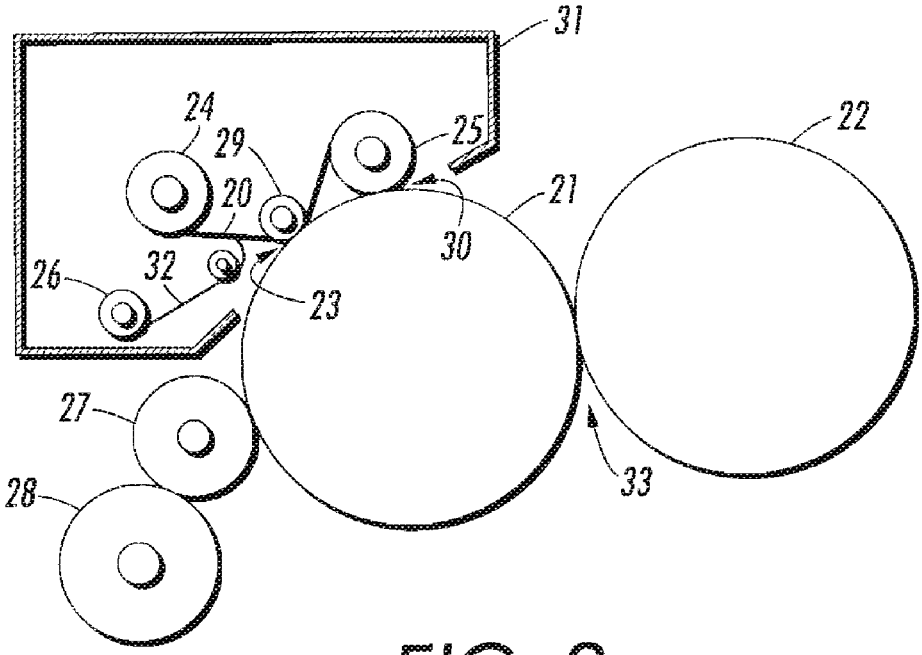
FIG. 2 is a schematic view showing an alternative embodiment of a fuser apparatus of the disclosure.

In some embodiments, however, the flexible substrate 20 may have a surface, opposite to the surface coated with the high surface-energy film, that has an abrasive texture or that is also coated with a high surface-energy film, such as that described above. In embodiments in which the opposite surface of the flexible substrate 20 has an abrasive surface, the take-up roll 25 may be positioned such that, as the flexible substrate 20 is wound onto the take-up roll 25, the abrasive surface of the flexible substrate 20 contacts the fuser member 21 at an additional cleaning nip 30. Contacting the abrasive surface with the fuser member 21 at cleaning nip 30 provides a scrubbing surface for pre-cleaning the fuser member 21 as the flexible substrate 20 is wound onto the take-up roll 25, as shown in FIG. 2. In embodiments in which the opposite surface of the flexible substrate 20 is coated with a second high surface-energy film, the take-up roll 25 may be positioned such that, as the flexible substrate 20 is wound onto the take-up roll 25, the second high surface-energy film contacts the fuser member 21 at an additional cleaning nip 30, to provide a scrubbing surface for pre-cleaning the fuser member 21 as the flexible substrate 20 is wound onto the take-up reel 25, as shown in FIG. 2.

In embodiments, the high surface-energy film may be further coated by a protective film 32, to prevent contamination of the high surface-energy film prior to contact with the fuser roll. The protective film 32 is removed incrementally from the high surface-energy film as it is withdrawn from the supply roll. The protective film 32 is then wound onto a take-up/storage roll 26.

Optionally, the cleaning system may further comprise any known release agent. The release agent may be impregnated into the flexible substrate, the high surface-energy film or the tension roll, and provided to the fuser member at cleaning nip 23 and/or cleaning nip 30. The release agent may be any known or conventionally used, or later developed, liquid or gelatinous release agents. Suitable release agents include a silicone oils including both functional and non-functional oils, and may be selected to be compatible with the rest of the system.

In embodiments, the cleaning system may be used at temperatures of from about 25° C. to about 200° C.

The cleaning system described herein can allow extend fuser roll life, prevent toner contamination of fuser rollers, and prevent contamination of rollers by toner particles and other contaminants and debris materials. While described herein with respect to fuser apparatuses used for electrophotographic processes, the cleaning system of embodiments may be used to clean roller surfaces in applications in which rollers are used and subject to particulate contamination, even at high temperatures.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuser apparatus comprising:

a fuser member and a pressure roll that are rotatably mounted parallel to and in contact with each other to form a fusing nip through which a recording medium with a toner image thereon is passed to permanently fix the image thereto;

a cleaning system for cleaning the fuser member, the cleaning system comprising:

a flexible material having a high surface energy surface, a flexible substrate, and an opposing surface, the flexible substrate being disposed between said high surface energy surface and said opposing surface;

a supply roll for providing said flexible material; and a take-up roll for taking-up said flexible material;

wherein:

said supply roll and take-up roll are each rotatably mounted parallel to said fuser member;

said flexible material contacts the fuser member to form a cleaning nip;

said flexible material is passed from the supply roll, through the cleaning nip and taken up on the supply roll;

said flexible material is oriented such that said high surface energy surface contacts said fuser member at said cleaning nip; and said take-up roll is positioned to contact said opposing surface with said fuser member.

2. The fuser apparatus according to claim 1, wherein said flexible material comprises a material having a high surface energy relative to debris or toner adhered to or present on the fuser member.

3. The fuser apparatus according to claim 1, wherein said flexible material comprises a material having a surface energy or electro-negativity that is more attractive to debris or toner adhered to or present on the fuser member than the surface of the fuser member.

4. The fuser apparatus according to claim 1, wherein said high surface energy surface is a surface of a layer coated onto said flexible substrate.

5. The fuser apparatus according to claim 1, wherein said flexible substrate comprises materials chosen from natural fibers, synthetic fibers and synthetic films.

6. The fuser apparatus according to claim 1, wherein rotation of said take-up roll withdraws said flexible material from said supply roll and pulls said flexible material through the cleaning nip, causing said supply roll to unwrap a relatively small portion of said flexible material.

7. The fuser apparatus according to claim 1, wherein said opposing surface is an abrasive surface.

8. The fuser apparatus according to claim 1, wherein said opposing surface has a high surface energy.

9. The fuser apparatus of claim 1, further comprising:

a second take-up roll; and a removable protective film that coats the high surface energy surface when the flexible material is disposed on said supply roll, wherein the removable protective film is removed from the high surface energy surface as it is withdrawn from said supply roll, and the removable protective film is wound onto said second take-up roll.

10. A method for cleaning a fuser apparatus, said method comprising:

contacting a fuser member with a flexible material having a high surface energy; and pre-cleaning said fuser member by contacting said fuser member with an opposing surface of said flexible material prior to contacting said fuser member with said film.

11. The method according to claim 10, wherein said opposing surface has an abrasive texture.

12. The method according to claim 10, wherein said opposing surface has a high surface energy.

13. The method according to claim 10, further comprising:

protecting the high surface energy surface with a removable protective film when the flexible material is disposed on a supply roll;

removing the removable protective film from the high surface energy surface as the flexible material is withdrawn from said supply roll; and winding the removable protective film onto a take-up roll.

14. A fuser apparatus comprising:

a fuser member and a pressure roll that are rotatably mounted parallel to and in contact with each other to form a fusing nip through which a recording medium with a toner image thereon is passed to permanently fix the image thereto;

a cleaning system for cleaning the fuser member, the cleaning system comprising:

a flexible material having a high surface energy surface;

a supply roll for providing the flexible material; and a take-up roll for taking-up the flexible material;

wherein:

said supply roll and take-up roll are each rotatably mounted parallel to said fuser member;

said flexible material contacts the fuser member to form a cleaning nip;

said flexible material is passed from the supply roll, through the cleaning nip and taken up on the supply roll;

said flexible material is oriented such that said high surface energy surface contacts said fuser member at said cleaning nip, and said flexible material has an abrasive surface that is opposite to said high surface energy surface, and said take-up roll is positioned to contact said abrasive surface with said fuser member.

15. The fuser apparatus of claim 14, further comprising:

a second take-up roll; and a removable protective film that coats the high surface energy surface when said flexible material is disposed on said supply roll, wherein the removable protective film is removed from the high surface energy surface as said flexible material is withdrawn from said supply roll, and the removable protective film is wound onto said second take-up roll.

* * * * *